US011463833B2

(12) United States Patent
Norvell et al.

(10) Patent No.: US 11,463,833 B2
(45) Date of Patent: Oct. 4, 2022

(54) METHOD AND APPARATUS FOR VOICE OR SOUND ACTIVITY DETECTION FOR SPATIAL AUDIO

(71) Applicant: Telefonaktiebolaget LM Ericsson (publ), Stockholm (SE)

(72) Inventors: Erik Norvell, Stockholm (SE); Stefan Bruhn, Sollentuna (SE)

(73) Assignee: TELEFONAKTIEBOLAGET LM ERICSSON (PUBL), Stockholm (SE)

( * ) Notice: Subject to any disclaimer, the term of this patent is extended or adjusted under 35 U.S.C. 154(b) by 203 days.

(21) Appl. No.: 16/303,455

(22) PCT Filed: May 18, 2017

(86) PCT No.: PCT/EP2017/061953
§ 371 (c)(1),
(2) Date: Nov. 20, 2018

(87) PCT Pub. No.: WO2017/202680
PCT Pub. Date: Nov. 30, 2017

(65) Prior Publication Data

US 2020/0314580 A1 Oct. 1, 2020

Related U.S. Application Data

(60) Provisional application No. 62/341,785, filed on May 26, 2016.

(51) Int. Cl.
*H04S 7/00* (2006.01)
*G10L 25/78* (2013.01)

(52) U.S. Cl.
CPC ..... *H04S 7/303* (2013.01); *G10L 25/78* (2013.01); *H04S 2400/01* (2013.01)

(58) Field of Classification Search
CPC .. H04S 7/303; H04S 2400/01; H04S 2400/03; H04S 1/002; H04S 1/005;
(Continued)

(56) References Cited

U.S. PATENT DOCUMENTS

2004/0042626 A1* 3/2004 Balan ..... G10L 25/78 381/110
2007/0021958 A1* 1/2007 Visser ..... G10L 21/0272 704/226
(Continued)

FOREIGN PATENT DOCUMENTS

WO 2012/061145 A1 5/2012

OTHER PUBLICATIONS

International Search Report and Written Opinion dated Aug. 18, 2017 issued in International Application No. PCT/EP2017/061953. (11 pages).
(Continued)

*Primary Examiner* — Thomas H Maung
(74) *Attorney, Agent, or Firm* — Rothwell, Figg, Ernst & Manbeck, P.C.

(57) ABSTRACT

A method and apparatus for voice or sound activity detection for spatial audio. The method comprises receiving direct source information source detection decision and a primary voice/sound activity decision, and producing a spatial voice/sound activity decision based on the direct source detection decision and the primary voice/sound activity decision.

24 Claims, 8 Drawing Sheets

(58) Field of Classification Search
CPC ..... H04S 1/007; H04S 3/002; H04S 3/004; H04S 3/006; H04S 3/008; H04S 3/02; H04S 5/005; H04S 5/02; H04S 7/30; H04S 7/302; H04S 7/304; H04S 7/305; H04S 7/306; H04S 2420/01; H04S 2420/03; G10L 25/78; G10L 25/81; G10L 25/84; G10L 25/87; G10L 19/00; G10L 19/008; G10L 2025/783; G10L 2025/786; G06F 3/16; G06F 3/162; G06F 3/165; G06F 3/167; H04N 5/60; H04N 5/602; H04N 5/607; H04R 29/00; H04W 76/28
See application file for complete search history.

(56) References Cited

U.S. PATENT DOCUMENTS

2008/0260169 A1* 10/2008 Reuss ..... H04R 27/00 381/58
2010/0232619 A1* 9/2010 Uhle ..... H04S 5/005 381/80
2010/0323652 A1* 12/2010 Visser ..... H04R 3/005 455/232.1
2011/0196682 A1* 8/2011 Sandgren ..... H04S 7/30 704/270
2011/0264447 A1* 10/2011 Visser ..... G10L 25/78 704/208
2012/0130713 A1* 5/2012 Shin ..... G10L 25/78 704/233
2012/0203549 A1* 8/2012 Naito ..... G10L 21/0208 704/233
2012/0316869 A1* 12/2012 Xiang ..... H04K 3/825 704/226
2013/0282369 A1* 10/2013 Visser ..... G10L 15/20 704/226
2014/0016786 A1* 1/2014 Sen ..... G10L 19/008 381/23
2014/0016793 A1* 1/2014 Gardner ..... H04M 3/56 381/63
2014/0023196 A1* 1/2014 Xiang ..... H04S 7/30 381/17
2014/0153742 A1 6/2014 Hershey et al.
2015/0104022 A1* 4/2015 Deng ..... H04S 1/007 381/27
2015/0172807 A1* 6/2015 Olsson ..... H04R 3/005 381/74
2016/0036987 A1* 2/2016 Cartwright ..... H04M 3/568 381/17
2016/0056787 A1* 2/2016 Lu ..... H04S 7/307 381/101
2016/0307581 A1* 10/2016 Salmela ..... H04S 3/008
2016/0337523 A1* 11/2016 Pandey ..... H04M 3/568
2017/0213556 A1* 7/2017 Buck ..... G10L 15/22
2017/0243577 A1* 8/2017 Wingate ..... G10L 15/20
2018/0048768 A1* 2/2018 Spittle ..... H04S 7/302
2019/0164568 A1* 5/2019 Matheja ..... G10L 25/21
2020/0245087 A1* 7/2020 Norris ..... H04S 3/008

OTHER PUBLICATIONS

Pfau, T et al., "Multispeaker Speech Activity Detection for the ICSI Meeting Recorder", XP010603688A, (2002). (4 pages).

* cited by examiner

METHOD AND APPARATUS FOR VOICE OR SOUND ACTIVITY DETECTION FOR SPATIAL AUDIO

CROSS REFERENCE TO RELATED APPLICATION(S)

This application is a 35 U.S.C. § 371 National Stage of International Patent Application No. PCT/EP2017/061953, filed May 18, 2017, designating the United States and claiming priority to U.S. provisional application No. 62/341,785, filed on May 26, 2016. The above identified provisional application is incorporated by reference.

TECHNICAL FIELD

The present application relates to spatial or multi-channel audio coding.

BACKGROUND

This section is intended to provide a background or context to the invention that is recited in the claims. The description herein may include concepts that could be pursued, but are not necessarily ones that have been previously conceived or pursued. Therefore, unless otherwise indicated herein, what is described in this section is not prior art to the description and claims in this application and is not admitted to be prior art by inclusion in this section.

Although the capacity in telecommunication networks is continuously increasing, it is still of great interest to limit the required bandwidth per communication channel. In mobile networks smaller transmission bandwidths for each call yields lower power consumption in both the mobile device and the base station. This translates to energy and cost saving for the mobile operator, while the end user will experience prolonged battery life and increased talk-time. Further, with less consumed bandwidth per user the mobile network can service a larger number of users in parallel. One such method for reducing the transmitted bandwidth in speech communication is to exploit natural pauses in speech. Since during most conversations only one talker is active at a time, the speech pauses will typically occupy more than half of the signal. The solution is to employ a Discontinuous Transmission (DTX) scheme, where the active signal coding is discontinued during speech pauses. During these pauses it is common to send a very low rate encoding of the background noise to allow for a Comfort Noise Generator (CNG) in the receiving end to fill the pauses. The CNG makes the sound more natural since the background noise is maintained and not switched on and off with the speech. It also helps to ensure the user that the connection is still active, since a complete silence may give the impression that the call has been disrupted. A DTX scheme further relies on a Voice Activity Detector (VAD), which tells the system whether to use the active signal encoding methods or the background noise coding triggering CNG at the receiver. The system may be generalized to include other source types by using a (Generic) Sound Activity Detector (GSAD or SAD), which not only discriminates speech from background noise but also may detect music or other signal types which are deemed relevant.

The benefits of a DTX system is that it reduces the overall transmission bandwidth, which in turn reduces the power consumption both in the mobile terminals and in the base stations and increases the capacity to serve more users. A potential drawback with the system is when the voice activity decision is inaccurate, which could result in the active speech signal being clipped or muted which makes it less intelligible. Since the CNG generally operates at a low bit rate, the background noise will also be modeled with less accuracy.

Spatial or 3D audio is a generic formulation which denotes various kinds of multi-channel audio signals. Depending on the capturing and rendering methods, the audio scene is represented by a spatial audio format. Typical spatial audio formats defined by the capturing system (microphones) are for example denoted as stereo, binaural, ambisonics, etc. Spatial audio rendering systems (headphones or loudspeakers) are able to render spatial audio scenes with e.g. channel or scene based audio signal representations such as stereo (left and right channels 2.0) or more advanced multi-channel audio signals (2.1, 5.1, 7.1, etc.) or ambisonics.

Recent technologies for the transmission and manipulation of such audio signals allow the end user to have an enhanced audio experience with higher spatial quality often resulting in a better intelligibility as well as an augmented reality. Spatial audio coding techniques, such as MPEG Surround or MPEG-H 3D Audio, generate a compact representation of spatial audio signals which is compatible with data rate constraint applications such as streaming over the internet for example. The transmission of spatial audio signals may however be further limited when the data rate constraint is strong and therefore post-processing of the decoded audio channels is also used to enhance the spatial audio playback. Commonly used techniques are for example able to blindly up-mix decoded mono or stereo signals into multi-channel audio (5.1 channels or more).

In order to efficiently render spatial audio scenes, the spatial audio coding and processing technologies make use of the spatial characteristics of the multi-channel audio signal. In particular, the time and level differences between the channels of the spatial audio capture are used to approximate the inter-aural cues which characterize perception of directional sounds in space. Since the inter-channel time and level differences are only an approximation of what the auditory system is able to detect, i.e. the inter-aural time and level differences at the ear entrances, it is of high importance that the inter-channel time difference is relevant from a perceptual aspect. The inter-channel time and level differences (ICTD and ICLD) are commonly used to model the directional components of multi-channel audio signals while the inter-channel cross-correlation (ICC), that models the inter-aural cross-correlation (IACC), is used to characterize the width of the audio image. Especially for lower frequencies the stereo image may as well be modeled with inter-channel phase differences (ICPD).

The binaural cues relevant for spatial auditory perception are called inter-aural level difference (ILD), inter-aural time difference (ITD) and inter-aural coherence or correlation (IC or IACC). When considering general multi-channel signals, the corresponding cues related to the channels are inter-channel level difference (ICLD), inter-channel time difference (ICTD) and inter-channel coherence or correlation (ICC). Since the spatial audio processing mostly operates on the captured audio channels, the "C" is sometimes left out and the terms ITD, ILD and IC are often used also when referring to audio channels. FIG. 1 illustrates these parameters. In FIG. 1 a spatial audio playback with a 5.1 surround system (5 discrete+1 low frequency effect) is shown. Inter-Channel parameters such as ICTD, ICLD and ICC are extracted from the audio channels in order to approximate the ITD, ILD and IACC, which models human perception of sound in space.

In FIG. 2, a typical setup employing the parametric spatial audio analysis is shown. FIG. 2 illustrates a basic block diagram of a parametric stereo encoder 201 and decoder 203. The stereo channels are down-mixed into a mono signal 207 that is encoded and transmitted to the decoder 203 together with encoded parameters 205 describing the spatial image. The parameter extraction 202 aids the down-mix process, where a downmixer 204 prepares a single channel representation of the two input channels to be encoded with a mono encoder 206. The extracted parameters are encoded by a parameter encoder 208. Usually some of the stereo parameters are represented in spectral subbands on a perceptual frequency scale such as the equivalent rectangular bandwidth (ERB) scale. The decoder performs stereo synthesis based on the decoded mono signal and the transmitted parameters. That is, the decoder reconstructs the single channel using a mono decoder 210 and synthesizes the stereo channels using the parametric representation. The decoded mono signal and received encoded parameters are input to a parametric synthesis unit 212 or process that decodes the parameters, synthesizes the stereo channels using the decoded parameters, and outputs a synthesized stereo signal pair.

Since the encoded parameters are used to render spatial audio for the human auditory system, it is important that the inter-channel parameters are extracted and encoded with perceptual considerations for maximized perceived quality.

SUMMARY

There are challenges to model a complex audio signal at low bitrates. Typically parametric models may help to increase the quality, but that brings the problem of applying the appropriate model for a certain signal portion. The signal portion may be a separation of the signal in time, frequency or in the 3D audio space.

The parametric spatial audio coder can benefit from an accurate VAD/CNG/DTX system, by adapting both the encoding of the down-mix signal and the parametric representation according to the signal type. That is, both a parameter encoder and a mono encoder can benefit from a signal classification such as a spatial VAD or foreground/background classifier.

According to an aspect, it is provided a method for voice or sound activity detection for spatial audio. The method comprises receiving direct source detection decision and a primary voice/sound activity decision, and producing a spatial voice/sound activity decision based on said direct source detection decision and the primary voice/sound activity decision.

According to another aspect, an apparatus is provided for spatial voice/sound activity detection. The apparatus is configured to receive direct source detection decision and a primary voice/sound activity decision, and to produce a spatial sound activity decision based on the direct source detection decision and the primary voice/sound activity decision.

According to another aspect, a computer program is provided. A computer program comprises instructions which, when executed by a processor, cause the processor to receive direct source detection decision and a primary voice/sound activity decision, and to produce a spatial voice/sound activity decision based on the direct source detection decision and the primary voice/sound activity decision.

According to another aspect, an apparatus is provided. The apparatus comprises an input for receiving a multi-channel input that comprises two or more input channels, a spatial analyser configured to produce spatial cues based on analysis of the received input channels, a direct sound detector configured to use said spatial cues for detecting presence of direct source, and a primary sound activity detector configured to produce a primary sound activity decision on the multi-channel input. The apparatus further comprises a secondary sound activity detector configured to produce a spatial sound activity decision based on said direct source detection decision and the primary sound activity decision.

According to another aspect, a method comprises receiving a spatial audio signal with more than a single audio channel, deriving at least one spatial cue from said spatial audio signal and deriving at least one monophonic feature based on a monophonic signal being derived from or a component of said spatial audio signal. The method further comprises producing a voice/sound activity decision based on said at least one spatial cue and said at least one monophonic feature.

BRIEF DESCRIPTION OF THE DRAWINGS

For a more complete understanding of example embodiments of the present invention, reference is now made to the following descriptions taken in connection with the accompanying drawings in which.

DETAILED DESCRIPTION

Figure 1:
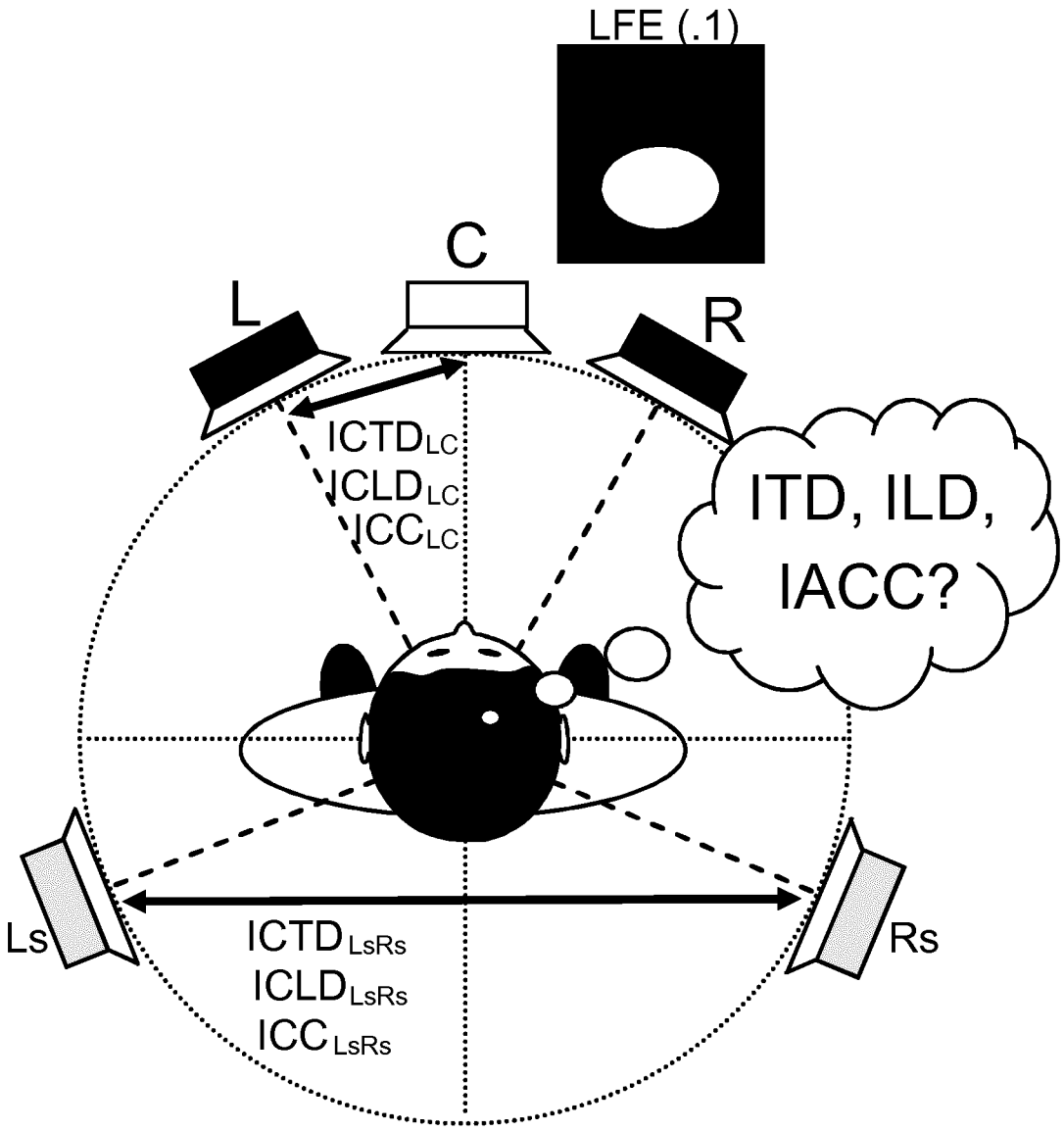
FIG. 1 illustrates spatial audio playback with a 5.1 surround system.

An example embodiment of the present invention and its potential advantages are understood by referring to FIGS. 1 through 14 of the drawings.

Considering a system designated to obtain spatial representation parameters for an audio input consisting of two or more audio channels. Each channel is segmented into time frames m. For a multi-channel approach, the spatial parameters are typically obtained for channel pairs, and for a stereo setup this pair is simply the left and the right channel. For simplicity the following description focuses on the spatial parameters for a single channel pair x[n, m] and y[n, m], where n denotes sample number and m denotes frame number.

In a first step, a spatial analysis is performed to obtain the spatial cues. Given the input waveform signals x[n, m] and y[n, m] of frame m, a cross-correlation measure is obtained. In this embodiment the Generalized Cross Correlation with Phase Transform (GCC PHAT) $r_{xy}^{PHAT}[\tau, m]$ may be used.

$$ICC(m) = \max_{\tau}(r_{xy}^{PHAT}[\tau, m]) \tag{1}$$

Other measures such as the peak of the normalized cross correlation function may also be used, i.e.

$$ICC(m) = \max_{\tau}\left(\frac{r_{xy}[\tau, m]}{\sqrt{r_{xx}[0, m]r_{yy}[0, m]}}\right) \tag{2}$$

Further, an ICTD estimate ICTD(m), is obtained. Preferably, the estimates for ICC and ICTD will be obtained using the same cross-correlation method to consume the least amount of computational power. The τ that maximizes the cross correlation may be selected as the ICTD estimate. Here, the GCC PHAT is used.

$$ICTD(m) = \arg\max_{\tau}(r_{xy}^{PHAT}[\tau, m]) \tag{3}$$

The inter-channel level difference (ICLD) is typically defined on a frequency subband basis. Given the input channels x[n, m] and y[n, m], let X[k, m] and Y[k, m] denote the corresponding frequency spectra for frequency index k. Assuming a DFT (discrete Fourier transform) transform is used, k denotes the spectral line of the transform of length N $$X[k, m] = \sum_{n=0}^{N-1} x[n, m]e^{-\frac{j2\pi kn}{N}} \tag{4}$$

In this case a subband may be formed by a vector of consecutive spectral lines k, such that $$X_b[m]=[X[k_{start(b)},m]X[k_{start(b)}+1,m] \ldots X[k_{end(b)},m]] \tag{5}$$

where $k_{start(b)}$ and $k_{end(b)}$ denote the limits in spectral lines of the subband $X_b[m]$. The subband resolution typically follows an approximation of the frequency resolution of the human auditory perception, such as the Equivalent Rectangular Bandwidth (ERB) or the Bark scale. The ICLD may then be defined as the log energy ratios of the subbands between the channels X[k, m] and Y[k, m], such as $$ICLD(b, m) = 10\log_{10}\frac{\sum_{k=k_{start(b)}}^{k_{end(b)}} |X[k, m]|^2}{\sum_{k=k_{start(b)}}^{k_{end(b)}} |Y[k, m]|^2} \tag{6}$$

Other frequency domain representations are possible, including other transforms such as e.g. DCT (discrete cosine transform), MDCT (modified discrete cosine transform) or filter banks such as QMF (quadrature mirror filter) or hybrid QMF, biquad filterbanks. In case a filter bank is used, the frequency subband $X_b[m]$ will denote the temporal samples of subband b, but the energy ratio may still be formulated as in equation (6).

The inter-channel phase difference (ICPD) may be defined as $$ICPD(b, m) = \text{atan2}\left(\frac{\text{Im}(X_b[m]^T Y_b[m]^*)}{\text{Re}(X_b[m]^T Y_b[m]^*)}\right) \tag{7}$$

i.e. the phase of the complex inner product, or dot product, $X_b[m]^T Y_b[m]^*$ where * denotes the complex conjugate operator and a tan 2 is the four-quadrant inverse tangent function.

It should be noted that the ICC and ICTD may be defined on a band basis, in a similar way as the ICLD and ICPD. However, in the context of detection and localization of a single source, a full band ICC and ICTD may be sufficient. If multiple sources are active at the same time, it may however be beneficial to use also ICC and ICTD on a band basis. If the parameters are defined on a band basis, the notation ICC(m), ICTD(m), ICLD(m) and ICPD(m) all correspond to vectors where the elements are the values of each parameter per band b, $$\begin{cases} ICC(m) = [ICC(m, b_1)\ ICC(m, b_2)\ \ldots\ ICC(m, b_{N_{band}})] \\ ICTD(m) = [ICTD(m, b_1)\ ICTD(m, b_2)\ \ldots\ ICTD(m, b_{N_{band}})] \\ ICLD(m) = [ICLD(m, b_1)\ ICLD(m, b_2)\ \ldots\ ICLD(m, b_{N_{band}})] \\ ICPD(m) = [ICPD(m, b_1)\ ICPD(m, b_2)\ \ldots\ ICPD(m, b_{N_{band}})] \end{cases} \tag{8}$$

where $N_{band}$ is the number of bands. Note that the band limits and number of bands may be different for each parameter.

The two spatial cues ICLD and ICTD may be used to approximate the position of the source. For a more complex (or realistic) audio capture scenario potentially including binaural capture and rendering, the phase differences ICPD may also be important.

VAD/CNG/DTX systems typically use spectral shape, signal level (relative to estimated noise level), and zero crossing rate or other noisiness measures to detect active speech in background noise. However, when these properties become similar between the desired foreground signal and the background signal, the discrimination becomes difficult. For instance, fricative onsets/offsets or low level onsets/offsets can often become indistinguishable from the background noise signal, leading to front-end or back-end clipping of the signal.

The parametric spatial audio coder can benefit from an accurate VAD/CNG/DTX system, by adapting both the encoding of the down-mix signal and the parametric representation according to the signal type. That is, both a parameter encoder and a mono encoder can benefit from a signal classification such as a spatial VAD or foreground/background classifier.

In an embodiment spatial cues are used as feature for VAD or SAD. Such spatial cues are e.g. degree of ICC, detection of localized source (in contrast to diffuse source, ambient noise), source location estimate (ICTD, ICPD, ICLD), etc. They may be used directly as additional features to features used traditionally in monophonic VADs/SADs such as (band) energy estimates, band SNR (estimates), zero crossing rate, etc.

The spatial cues are used to determine presence of signal components, such as foreground/background or a direct talker or music (instrument) source in front of a noise background. A foreground signal is characterized by capture of the direct sound which gives high inter-channel correlation (ICC) or other of the above mentioned features that let distinguish a direct or localized source from a background signal.

Figure 3:
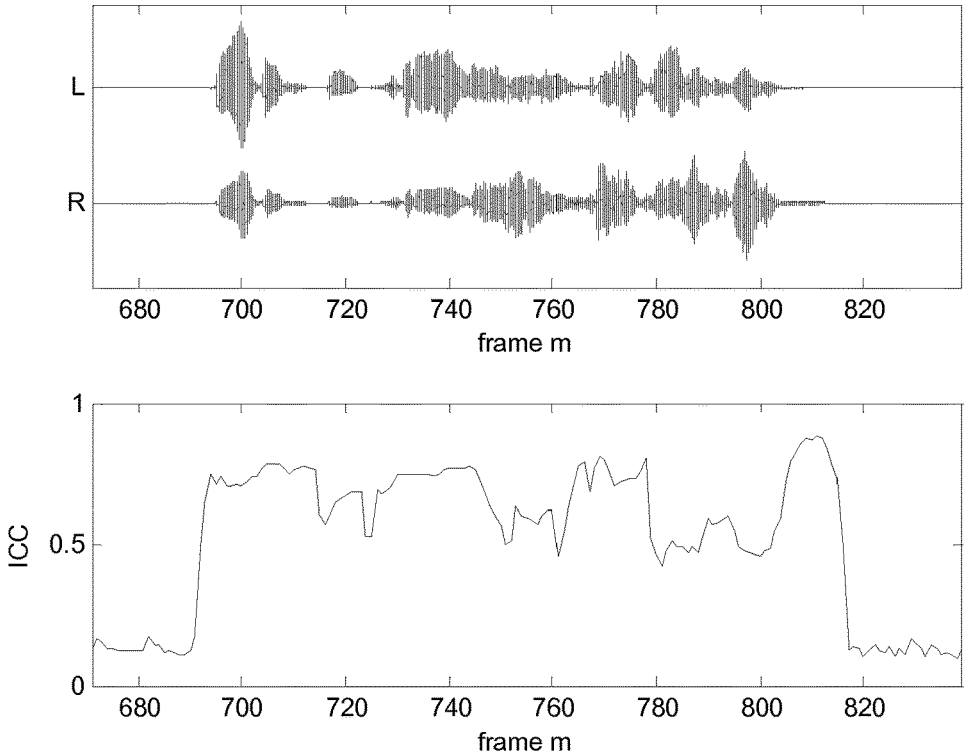
FIG. 3 illustrates the ICC parameter for a stereo speech utterance.

FIG. 3 illustrates the ICC parameter for a stereo speech utterance. At the onset of the signal, even when the signal level is relatively low, the ICC increases. This indicates the presence of a direct source even if the relative level is low. At the end of the utterance, the ICC stays at a high level even for the low-energy tail of the signal, giving a more accurate indication when the utterance ends. The high region of the ICC forms a direct source segment, indicating when there is a direct source present in the input channels.

The spatial cues of a source may be combined with a VAD/SAD to classify the source as a talker or other type of source like music instrument or a background signal. The combination may be done such that these cues are used as additional VAD/SAD features. Other types of signal classifiers may also be used to identify the desired foreground source(s).

When the properties of the foreground/background in mono become close or similar, the spatial audio dimension (through spatial cues) may be used to discriminate between the signal classes. For instance, fricatives are often cut short (back-end clipping) in presence of background noise. However, even for low level signals and fricatives, an inter-channel correlation measure may be used to detect that the signal is coming from a direct source.

Another aspect of the embodiments of the invention is that they may be used as a scene analysis of the talker positions and aid in an annotation or speaker diarization.

A known issue for the VAD is to correctly detect the end of a speech utterance, without cutting the speech too early. This problem is known as back-end clipping of the VAD. A common solution is to keep the VAD active for an additional number of frames when the voice is no longer detected, also referred to a VAD hang-over or VAD hysteresis period. The fixed number hang-over frames may lead to wasted resources. The spatial VAD may help to accurately find the end of the speech utterance without a fixed hang-over period.

In two more specific embodiments described below, the spatial cues can be used in a two-level VAD or SAD composed of a state-of-the-art primary VAD/SAD and a spatial cue detector that is composed of the following elements.

An example of Two-level spatial VAD:

1. Employ primary VAD to detect speech. Primary VAD is optimized to provide reliable decisions, possibly involving extra delay.
2. While primary VAD detects speech, associate spatial cue, e.g., degree of ICC, detection of localized source (in contrast to diffuse source, ambient noise), source location estimate (ICTD, ICPD, ICLD), with active speech.
3. Employ secondary VAD that decides on fast or instantaneous (frame) basis in response to detection of spatial cues previously associated with speech.

Figure 4A:
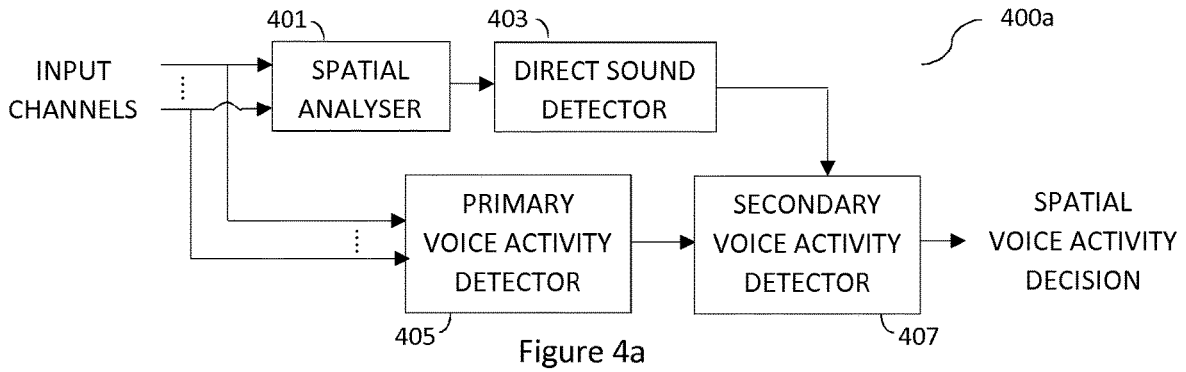
FIG. 4*a* shows an example of a spatial voice activity detector.
Figure 5A:
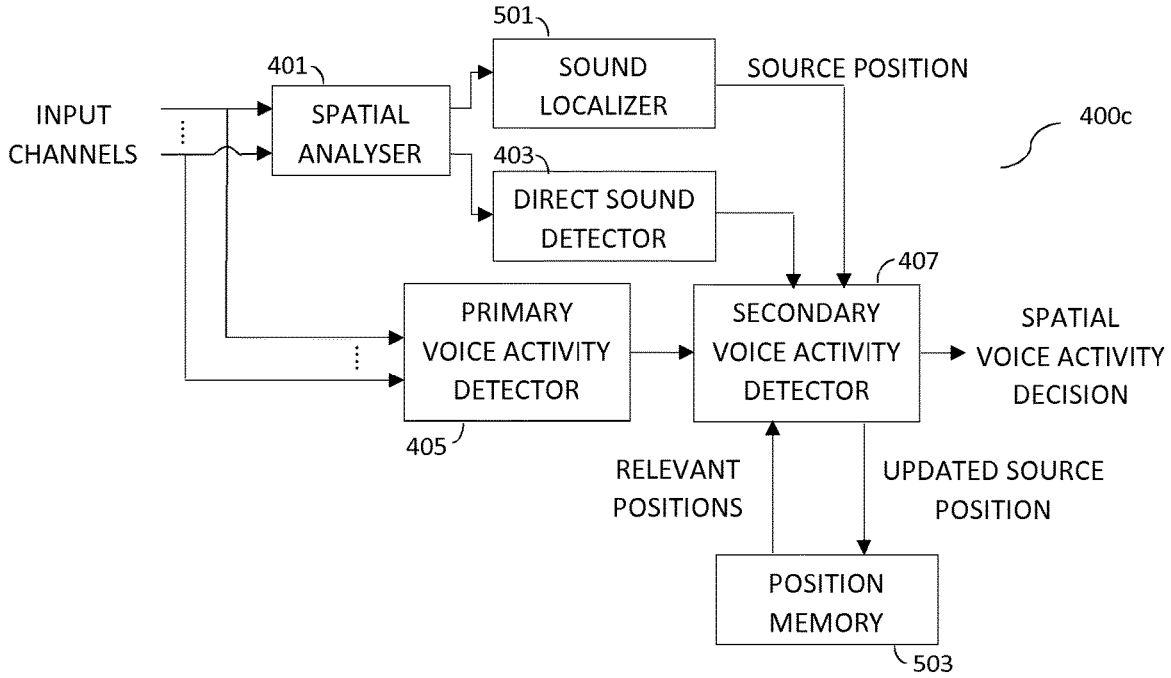
FIG. 5*a* shows another example of a spatial voice activity detector.

A schematic illustration of this example embodiment is shown in FIGS. 4*a* and 5*a*. FIG. 4*a* describes a system without the localization of the source. The primary VAD is complemented with direct sound detector to improve the accuracy of the spatial VAD. FIG. 5*a* outlines a spatial VAD system according to another example embodiment, including a source localization and position memory.

In the following description the terms direct sound detector and direct source detector as well as direct sound detection and direct source detection are used interchangeably.

In FIG. 4*a* an overview of a spatial voice activity detector 400*a* is shown. The spatial analyzer 401 operates on the input channels to produce the spatial cues. A primary voice activity decision is made on the multi-channel input by a primary voice activity detector 405. The spatial cues (for instance the ICC) is fed into the direct sound detector 403 that detects if a direct source is present. The secondary voice activity detector 407 uses the primary voice activity decision together with the direct source detection decision and produces a spatial voice activity decision. The spatial voice activity decision is positive if there is a direct source detected and if the primary VAD is active. In one embodiment the spatial voice activity decision remains active for as long as the direct source is present, even if the primary VAD should go inactive.

FIG. 5*a* shows an overview of a spatial voice activity detector 400*c* including a primary voice activity detector 405, a sound localizer 501 and a position memory 503. The spatial analyzer 401 extracts spatial cues relevant for both direct sound detection and sound localization. The sound localizer 501 extracts the position indicating spatial cues and feeds them to the secondary voice activity detector 407. together with the direct sound detector decision from the direct sound detector 403 and the primary voice activity detector decision. The obtained source position is compared to the relevant positions stored in the position memory 503, and if there is a match the position is deemed relevant. The spatial voice activity decision is positive if there is a direct source detected and if the primary VAD is active or if a relevant position is matched or both. That is, spatial VAD=1 if direct source=1 AND (primary VAD=1 OR relevant position=1). In case the spatial VAD is set active, the source position is also updated to account for new audio scenes or changing audio scenes.

Figure 6A:
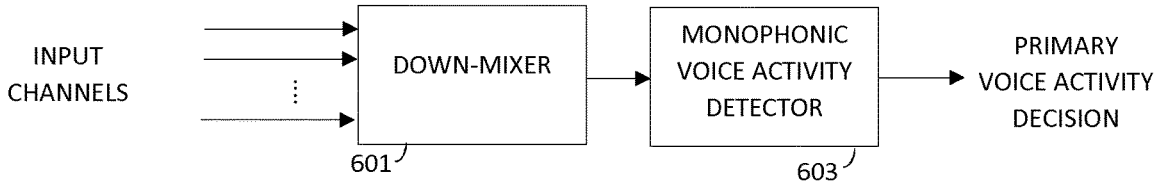
FIG. 6*a* shows an example of a multi-channel voice activity detector.

FIG. 6*a* illustrates an example of how a multi-channel voice activity detector (such as the primary voice activity detector 405) may be realized with a monophonic voice activity detector 603. The multi-channel input is first down-mixed by a down-mixer 601 to a monophonic channel, which in turn is fed to the monophonic voice activity detector 603 that produces a primary voice activity decision.

Figure 7A:
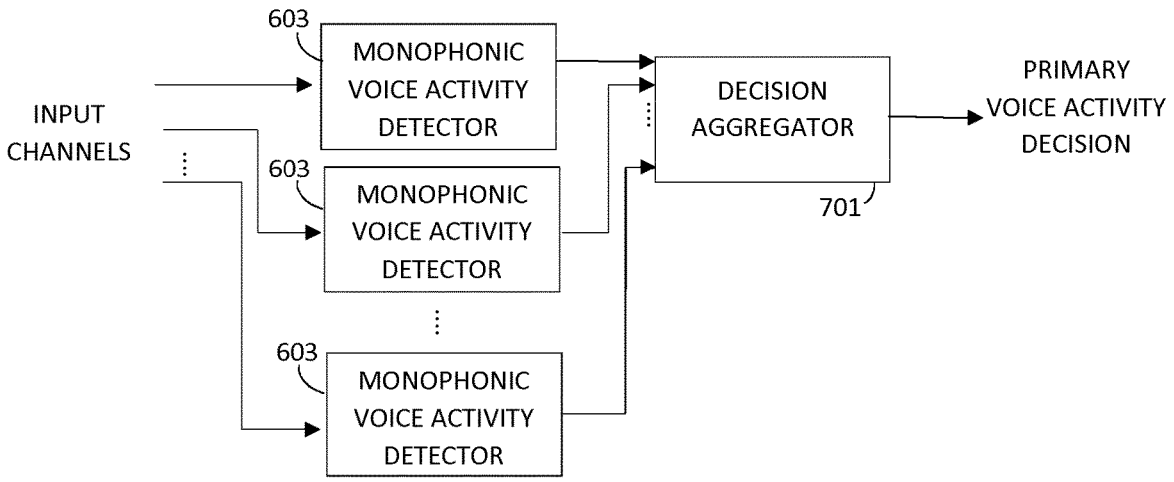
FIG. 7*a* shows another example of a multi-channel sound activity detector.

FIG. 7*a* illustrates another example of realization of a multi-channel voice activity detector using a monophonic voice activity detector 603. Monophonic voice detection is run on each channel individually, producing a voice activity decision per channel. The decision is then aggregated in the decision aggregator 701, for instance by using majority decision. The decision may also be biased towards a certain decision, e.g. if any voice activity detector signals active voice, the overall decision is active voice.

Figure 8A:
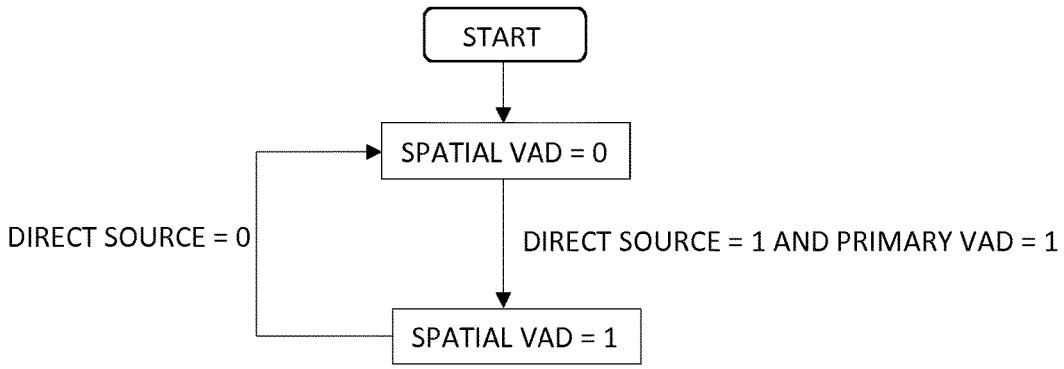
FIG. 8*a* illustrates an example embodiment for combining the direct source decision and primary VAD decision.
Figure 9A:
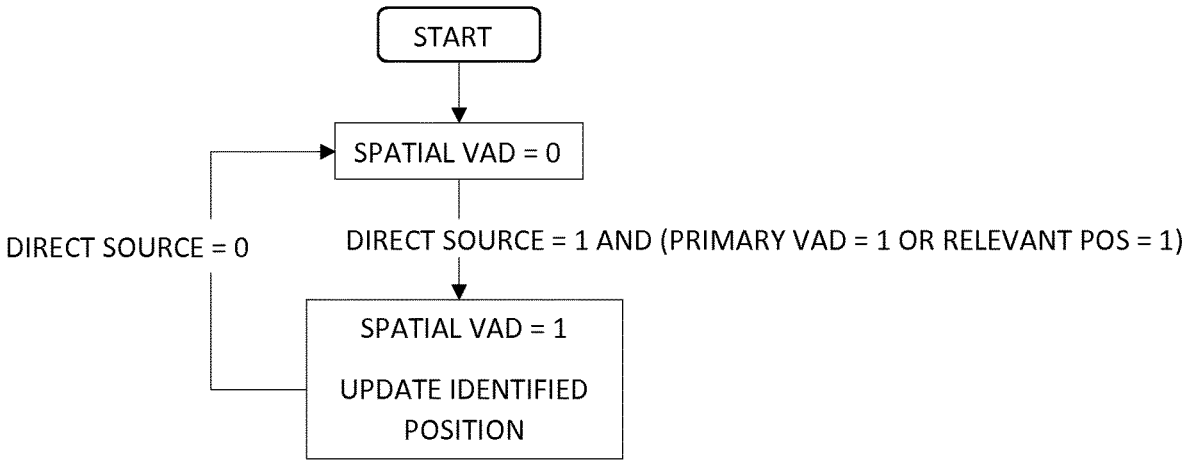
FIG. 9*a* illustrates an example embodiment for combining the direct source decision, primary VAD decision and relevant position decision.
Figure 10A:
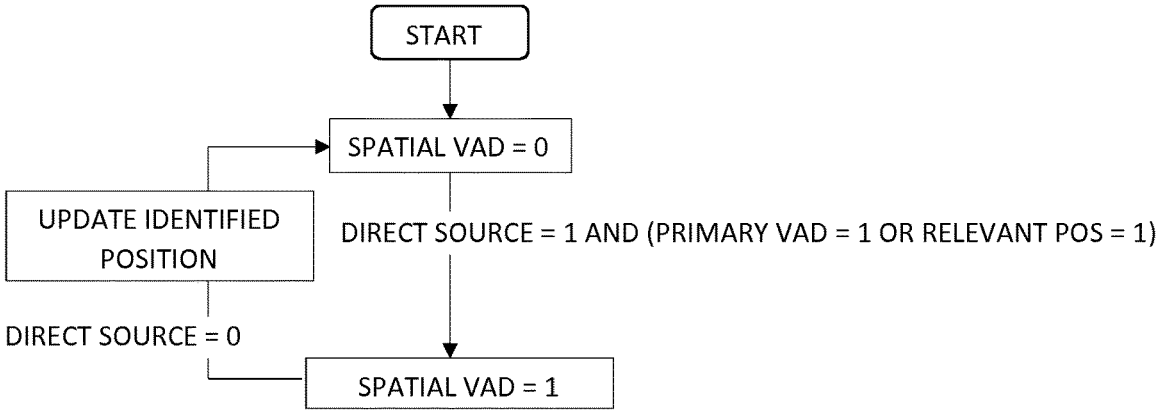
FIG. 10*a* illustrates an example embodiment for combining the direct source decision, primary VAD decision and relevant position decision.

Three flowcharts describing example embodiments of the invention are illustrated in FIGS. 8*a*, 9*a* and 10*a*. FIG. 8*a* illustrates a variant that uses a primary VAD together with a direct source detector, while FIG. 9*a* further includes a relevant source position decision based on source localization and a position memory. In FIG. 9*a*, the identified source position is updated continuously during the direct source segment, while FIG. 10*a* illustrates a variant where the source position is averaged and updated at the end of the direct source segment.

FIG. 8*a* shows a flow chart, or a state machine, illustrating an example embodiment for combining the direct source decision and primary VAD decision into a spatial VAD decision. The spatial VAD is active if there is a direct source detected and if the primary VAD is active. The spatial VAD remains active for as long as the direct source is present, even if the primary VAD should go inactive. This serves as a replacement for the hang-over logic often used to replace back-end clipping of speech segments.

FIG. 9*a* shows a flow chart, or a state machine, illustrating an example embodiment for combining the direct source decision, primary VAD decision and relevant position decision into a spatial VAD decision. This variant can activate the spatial VAD decision based on either the combination of direct source detection with an active primary VAD or direct source detection with relevant position detection or both. The identified position is continuously updated during the direct source segment.

FIG. 10*a* shows a flow chart, or a state machine, illustrating an example embodiment for combining the direct source decision, primary VAD decision and relevant position decision into a spatial VAD decision. This system is similar to the one described in FIG. 9*a*, apart from the updating of the position. Here the identified position is updated at the end of the direct source segment instead of updating it continuously during the direct source segment.

An example of Two-level spatial SAD:

1. Employ primary SAD to detect speech, music or background noise. Primary SAD is optimized to provide reliable decisions, possibly involving extra delay.
2. While primary SAD detects speech or music, associate spatial cue, e.g., degree of ICC, detection of localized source (in contrast to diffuse source, ambient noise), source location estimate (ICTD, ICPD, ICLD), with active speech or music.
3. Employ secondary SAD that decides on fast or instantaneous (frame) basis in response to detection of spatial cues previously associated with speech, music or background noise.

Figure 4B:
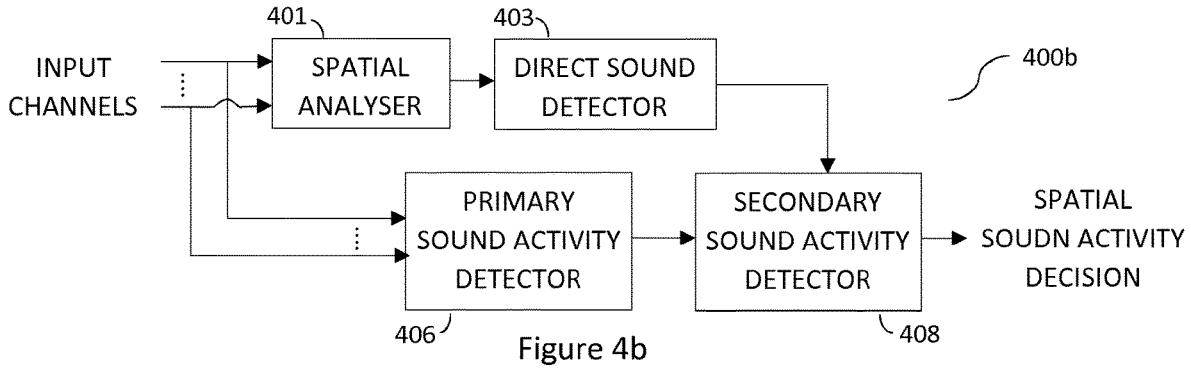
FIG. 4*b* shows an example of a spatial sound activity detector.
Figure 5B:
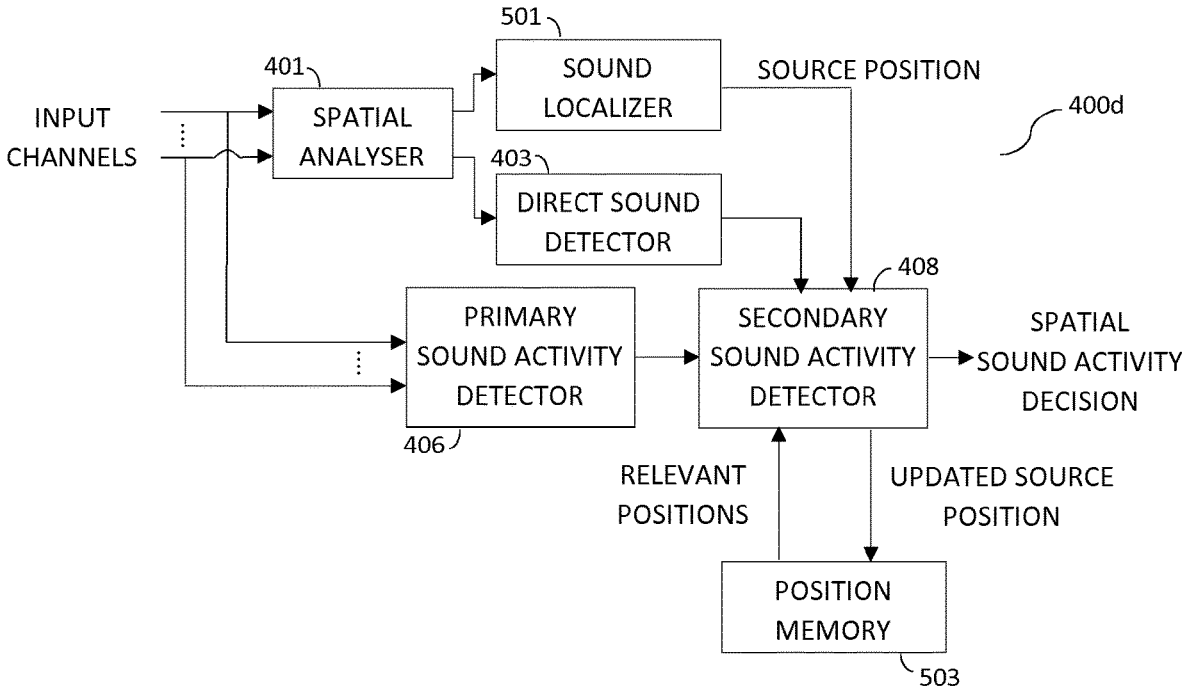
FIG. 5*b* shows another example of a spatial sound activity detector.

A schematic illustration of this embodiment is shown in FIGS. 4*b* and 5*b*. FIG. 4*b* describes a system without the localization of the source. The primary SAD is complemented with direct sound detector to improve the accuracy of the spatial SAD. FIG. 5*b* outlines a spatial SAD system according to this embodiment, including a source localization and position memory.

FIG. 4*b* shows an overview of a spatial (generic) sound activity detector 400*b*. The spatial analyzer 401 operates on the input channels to produce the spatial cues. A primary sound activity decision is made on the multi-channel input by a primary sound activity detector 406. The spatial cues (for instance the ICC) is fed into the direct sound detector 403 which detects if a direct source is present. The secondary sound activity detector 408 uses the primary sound activity decision together with the direct source detection decision and produces a spatial sound activity decision. It is otherwise similar to VAD in FIG. 4*a*, but uses a primary sound activity detector instead of a primary voice activity detector, and produces a spatial sound activity decision. The spatial sound activity decision is positive if there is a direct source detected and if the primary SAD is active. In one embodiment the spatial sound activity decision remains active for as long as the direct source is present, even if the primary SAD should go inactive.

FIG. 5*b* shows an overview of a spatial sound activity detector 400*d* including a primary sound activity detector 406, a sound localizer 501 and a position memory 503. The spatial analyzer 401 extracts spatial cues relevant for both direct sound detection and sound localization. The sound localizer 501 extracts the position indicating spatial cues and feeds them to the secondary sound activity detector 408, together with the direct sound detector decision from the direct sound detector 403 and the primary sound activity detector decision. The obtained source position is compared to the relevant positions stored in the position memory 503, and if there is a match the position is deemed relevant. The spatial sound activity decision is positive if there is a direct source detected and if the primary SAD is active or if a relevant position is matched or both. That is, spatial SAD=1 if direct source=1 AND (primary SAD=1 OR relevant position=1). In case the spatial SAD is set active, the source position is also updated to account for new audio scenes or changing audio scenes.

Figure 6B:
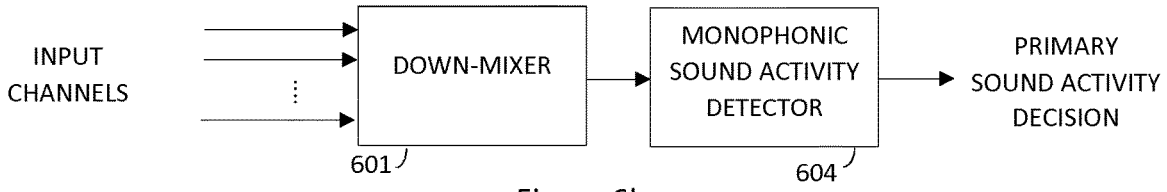
FIG. 6*b* shows an example of a multi-channel sound activity detector.

FIG. 6*b* illustrates an example of how a multi-channel sound activity detector (such as the primary sound activity detector 406) may be realized with a monophonic sound activity detector 604. The multi-channel input is first down-mixed by a down-mixer 601 to a monophonic channel, which in turn is fed to the monophonic sound activity detector 604 that produces a primary sound activity decision.

Figure 7B:
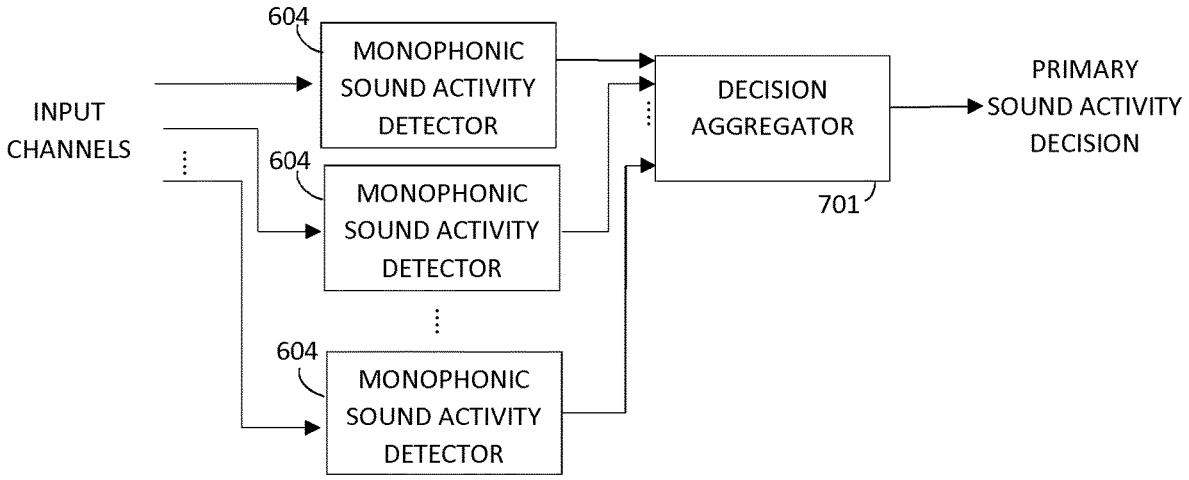
FIG. 7*b* shows another example of a multi-channel sound activity detector.

FIG. 7*b* illustrates another example of realization of a multi-channel sound activity detector using a monophonic sound activity detector 604. Here, a monophonic sound detection is run on each channel individually, producing a sound activity decision per channel. The decision is then aggregated in the decision aggregator 701, for instance by using majority decision. The decision may also be biased towards a certain decision, e.g. if any sound activity detector signals active sound, the overall decision is active sound.

Figure 8B:
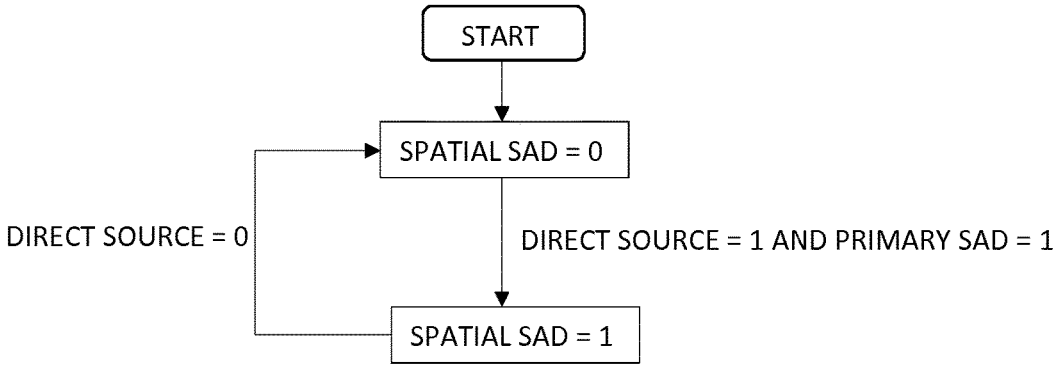
FIG. 8*b* illustrates an example embodiment for combining the direct source decision and primary SAD decision.
Figure 9B:
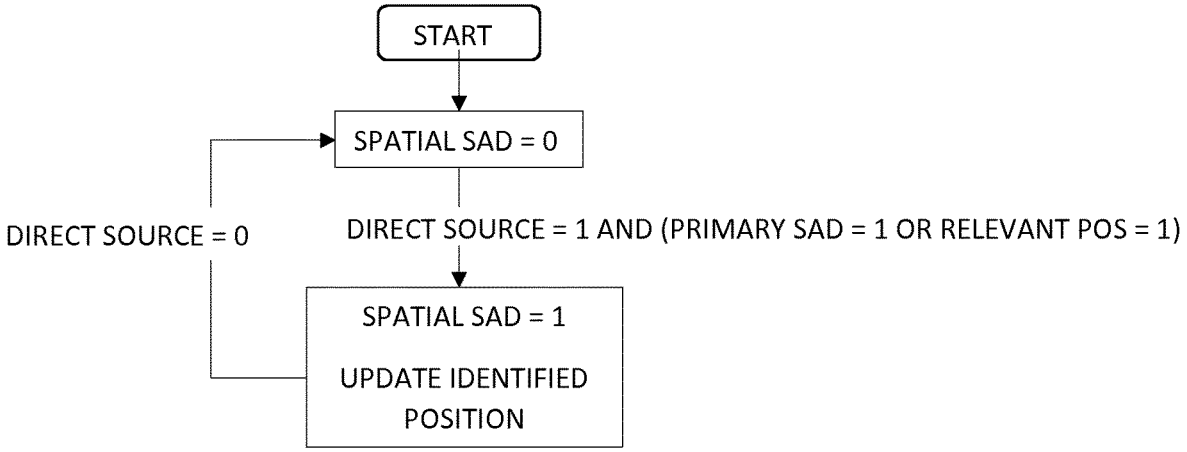
FIG. 9*b* illustrates an example embodiment for combining the direct source decision, primary SAD decision and relevant position decision.
Figure 10B:
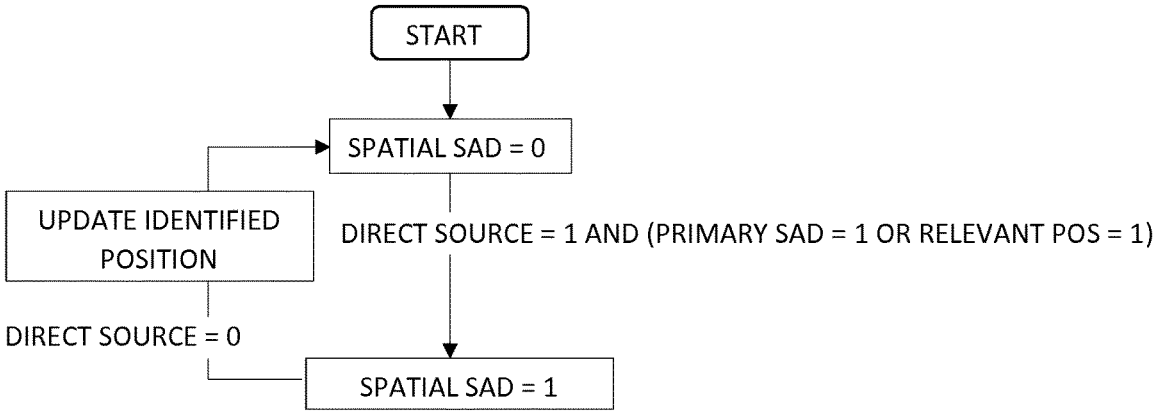
FIG. 10*b* illustrates an example embodiment for combining the direct source decision, primary SAD decision and relevant position decision.

Three flowcharts describing example embodiments of the invention are shown in FIGS. 8*b*, 9*b* and 10*b*. FIG. 8*b* illustrates a variant that uses a primary SAD together with a direct source detector, while FIG. 9*b* further includes a relevant source position decision based on source localization and a position memory. In FIG. 9*b*, the identified source position is updated continuously during the direct source segment, while FIG. 10*b* illustrates a variant where the source position is averaged and updated at the end of the direct source segment.

FIG. 8*b* shows a flow chart, or a state machine, illustrating an example embodiment for combining the direct source decision and primary SAD decision into a spatial SAD decision. The flow chart of FIG. 8*b* is similar to the flow chart of FIG. 8*a* but with a spatial SAD instead of a spatial VAD. The spatial SAD is active if there is a direct source detected and if the primary SAD is active. The spatial SAD remains active for as long as the direct source is present, even if the primary SAD should go inactive. This serves as a replacement for the hang-over logic.

FIG. 9*b* shows a flow chart, or a state machine, illustrating an example embodiment for combining the direct source decision, primary SAD decision and relevant position decision into a spatial SAD decision. The flow chart of FIG. 9*b* is similar to the flow chart of FIG. 9*a* but with a spatial SAD instead of a spatial VAD. This variant can activate the spatial SAD decision based on either the combination of direct source detection with an active primary SAD or direct source detection with relevant position detection or both. The identified position is continuously updated during the direct source segment.

FIG. 10*b* shows a flow chart, or a state machine, illustrating an example embodiment for combining the direct source decision, primary SAD decision and relevant position decision into a spatial SAD decision. The flow chart of FIG. 10*b* is similar to the flow chart of FIG. 10*a* but with a spatial SAD instead of a spatial VAD. That is, this system is similar to the one described in FIG. 9*b*, apart from the updating of the position. Here the identified position is updated at the end of the direct source segment instead of updating it continuously during the direct source segment.

If the VAD/SAD classifies the direct source as a talker or e.g. music instrument signal, the position of the talker/instrument is stored such that the system may react with more certainty the next time a direct signal is detected from the same position. This leads to improved onset detection of a talk spurt or when a music instrument resumes playing after a pause. In addition, during an active speech segment, the end of the speech segment may be easier and more reliably detected when using the spatial cue detector indicating a direct sound associated with the active speech/music detection of the primary VAD/SAD.

A further aspect of embodiments is that the spatial cues may be used for the decision to perform updates of the background noise estimate in a primary VAD/SAD. Spatial cues indicating the absence of a direct or localized talker or music instrument signal and rather indicating of a mere diffuse ambient background signal may trigger the updating of the background noise estimator.

Even a further aspect of embodiments is to use spatial cues in combination of a primary VAD or SAD decision in order to analyze the acoustical scene. If for instance an active speech decision of a primary VAD can be associated with spatial cues of two different locations, this can be used as indication for the presence of two talkers. Likewise, association of particular spatial cues of a particular location with an SAD decision for music indicates the presence of a music instrument at that location.

A possible realization of these embodiments is further described in the following sections.

Direct Source Detector

Given the definition of the spatial cues, a direct source detector can be created. One way to implement such a detector is to use the ICC, where a high ICC indicates a direct source is present:

$$DS(m) = \begin{cases} 1, & ICC(m) > ICC_{thr} \\ 0, & ICC(m) \le ICC_{thr} \end{cases} \tag{9}$$

where DS(m)=1 indicates a direct source is present. The threshold $ICC_{thr}$ may be made adaptive to the properties of the signal, giving an evolving threshold $ICC_{thr}(m)$ for each frame m. This may be done by comparing the relative peak magnitude to a threshold $ICC_{thres}(m)$ based on the remaining values in the cross correlation function, e.g., $r_{xy}^{PHAT}[\tau,m]$ or $r_{xy}[\tau, m]$ Such a threshold can for instance be formed by a constant $C_{thr} \in [0,1]$ multiplied by the standard deviation estimate of the cross correlation function.

$$ICC_{thr}(m) = C_{thr}\sqrt{\frac{1}{2\tau_{max}}\sum_{\tau=-\tau_{max}}^{\tau_{max}}(r_{xy}^{PHAT}[\tau]-\bar{r})^2} \tag{10}$$

$$\bar{r} = \frac{1}{2\tau_{max}+1}\sum_{\tau=-\tau_{max}}^{\tau_{max}} r_{xy}^{PHAT}[\tau] \tag{11}$$

For a more stable threshold, a low-pass filter may be applied:

$$ICC_{LP,thr}(m) = \alpha ICC_{thr}(m) + (1-\alpha)ICC_{LP,thr}(m-1) \tag{12}$$

$$\begin{cases} \alpha = \alpha_{UP}, & ICC(m) > ICC_{LP}(m-1) \\ \alpha = \alpha_{DOWN}, & ICC(m) \le ICC_{LP}(m-1) \end{cases} \tag{13}$$

For a slowly evolving $ICC_{LP,thr}(m)$, possible values for $\alpha_{UP}$, $\alpha_{DOWN}$ are $\alpha_{UP}=\alpha_{DOWN}=0.1$. It may be beneficial to follow the peak envelope of the $ICC_{thr}(m)$. A fast attack/slow decay strategy may be employed if $\alpha_{UP} \in [0,1]$ is set relatively high (e.g. $\alpha_{UP}=0.9$) and $\alpha_{DOWN} \in [0,1]$ is set relatively low (e.g. $\alpha_{DOWN}=0.1$). The direct source detector would then compare the instantaneous ICC with this threshold:

$$DS(m) = \begin{cases} 1, & ICC(m) > ICC_{LP,thr} \\ 0, & ICC(m) \le ICC_{LP,thr} \end{cases} \tag{14}$$

Another method is to sort the search range and use the value at e.g. the 95 percentile multiplied with a constant.

$$ICC_{thr}(m) = C_{thres2}r_{xy,sorted}^{PHAT}[\tau_{95}] \tag{15}$$

$$\begin{cases} r_{xy,sorted}^{PHAT}[\tau] = \mathrm{sort}(r_{xy}^{PHAT}[\tau]) \\ \tau_{95} = \lfloor(2\tau_{max}+1)\cdot 0.95 + 0.5\rfloor \\ C_{thres2} = 3 \end{cases} \tag{16}$$

where sort( ) is a function which sorts the input vector in ascending order. The threshold $ICC_{thr}(m)$ of equation (15) may be used to form a direct source detector as described in equation (9), or including a low-pass filter as in equations (12) and (13).

Direct Source Location Memory

While the ICC parameter indicates the diffuseness/directness of the source, the remaining spatial cues ICLD, ICTD and ICPD may be used to indicate the position or direction of arrival (DOA) of the source. Once it has been determined that a direct source is a relevant source, it may be beneficial to store the position or DOA of the source. By maintaining a set of relevant source observations, POS={$P_1$, $P_2$, . . . $PN_{pos}$} the position of the source may further improve the accuracy of the direct source relevance determination. Given a relevant source, the position may be stored in a vector format with the spatial cues, $$P_1=[\mathrm{ICLD}(m)\mathrm{ICTD}(m)\mathrm{ICPD}(m)] \tag{17}$$

where $P_1$ is a row vector containing the position information for relevant source number 1. It may also be beneficial to store identified sources which are deemed irrelevant, for faster dismissal of such a source. This can, e.g., be a known noise source which is to be ignored at all times. To determine if an observed direct source is among the set of stored sources, a distance measure $D(P_1, P_2)$ between source positions needs to be defined. Such a distance measure may for instance be defined as $$D(P_1,P_2)=(|P_1-P_2|^{\circ\alpha})w^T \tag{18}$$

Where $\circ\alpha$denotes the Hadamard power (element-wise power) of the vector elements, and w is a row vector of weights with the same length as $P_1$ and $P_2$. The transpose of w makes this an inner product which means $D(P_1, P_2)$ is a scalar. If $\alpha=2$ and w=[1 1 . . . 1], this is the squared Euclidian distance between the vectors $P_1$ and $P_2$. If the distance is below a certain threshold, $$D(P_1,P_2)<D_{thr} \tag{19}$$

the positions are regarded equal and the direct sound is regarded coming from a known source in the set of recorded positions. The values for $\alpha$, w and $D_{thr}$ need to be set in a way that allows natural fluctuations in the position vector, e.g. coming from small movements of a talker. If the scene is expected to change, the positions should also have a limited life time such that old positions are forgotten and removed from the set.

It is necessary to implement a procedure for updating the positions, both when the system is doing a fresh start and the current audio scene is unknown and to adapt to changes in the audio scene. Once a relevant source position has been identified, either the position is previously known or not, the source position is updated and stored in the memory. The stored position may e.g. be the last observed position in the direct source segment, sampled at when the direct source detector is inactive. Another example is to form an average over the observed positions during the entire direct source segment or to low-pass filter the position vector during the direct source segment to obtain a slowly evolving source position.

Direct Source Relevance Determination

Once the direct source detector has indicated that a direct source is present, a signal classifier may be used to determine whether the direct source is relevant or not. For the case of a speech communication, this can be done by running the input signal through a VAD to determine if the source represents a speech signal. In a more general case, other signal types may also be determined, such as music instruments or other objects with a discriminative audio signature.

The audio signal classifier may be configured to run on the original multi-channel input, or on a down-mixed version of the input signals. For a stereo input channel pair x[n], y[n] a simple down-mix can be obtained by just adding the signals and applying a scaling factor $\beta$.

$$z[n]=\beta(x[n]+y[n]) \tag{20}$$

For a typical passive down-mix this factor is fixed, e.g. $\beta=½$ or $\beta=\sqrt{½}$, but it is commonly adapted to the signal to preserve the energy in the down-mixed signal z[n]. There are many existing technologies for VAD or SAD for a monophonic channel which may be employed here. A primary VAD applied on a down-mix signal is illustrated in FIG. 6*a*. In case of a multi-channel VAD or SAD, another possible implementation is to use a monophonic VAD/SAD on each channel and aggregate the multiple output decisions. This can for instance be a majority decision, where the most frequent decision is chosen, or it can be a bias towards a specific decision. For instance, a multi-channel VAD could trigger if any of the channel VAD triggers. An illustration of an aggregated multiple monophonic VAD system is illustrated in FIG. 7*a*.

As described above, one method for relevance determination is to apply a signal classifier such as the VAD/SAD and indicate the source is relevant if the desired signal class is found, i.e. Primary VAD=1.

One way to complement the relevance determination is to use the direct source location memory, and signal that the source is relevant if the position matches a previously observed relevant source. This can be done by comparing the observed position $P_{obs}$ with the set of known positions POS and see if any source is within the defined distance threshold.

$$\text{Relevant } POS = \begin{cases} 1, & (\exists P_x)[P_x \in POS \text{ and } D(P_{obs}, P_x) < D_{thr}] \\ 0, & \text{otherwise} \end{cases} \tag{21}$$

Figure 11:
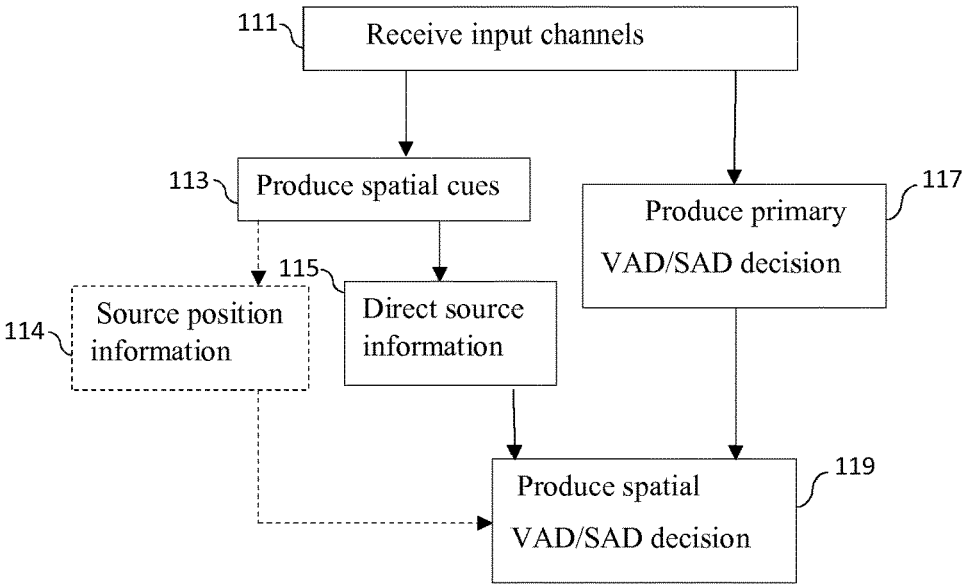
FIG. 11 shows a method performed by a spatial VAD/SAD

FIG. 11 summarizes a method for voice or sound activity detection for spatial audio, the method being performed by a spatial voice or sound activity detector. The method comprises receiving multi-channel input 111 that comprises two or more input channels, and producing spatial cues 113 based on analysis of the received input channels. Using spatial cues for detecting presence of direct source 115 and optionally detecting position of the source 114. Further, producing a primary VAD/SAD decision 117 on the multi-channel input. Producing a spatial VAD/SAD decision 119 based on the primary VAD/SAD decision and the direct source detection decision, and optionally on the position information.

Figure 12:
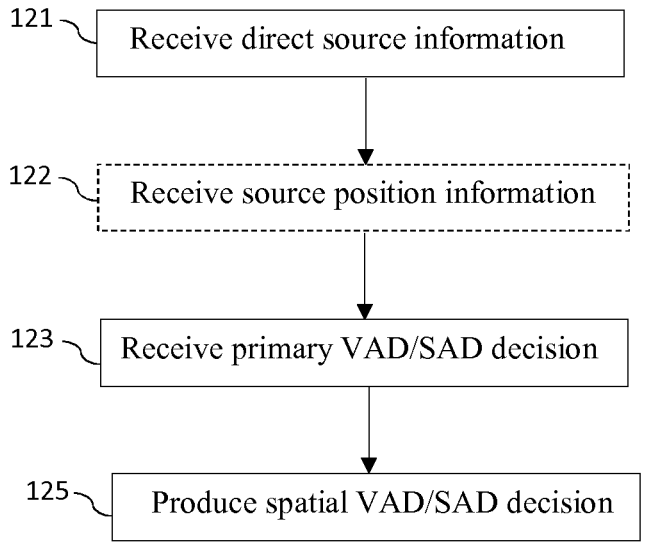
FIG. 12 shows a method performed by a secondary VAD/SAD

FIG. 12 shows a method of producing a spatial VAD/SAD decision by a secondary VAD/SAD. The secondary VAD/SAD receives the direct source detection decision 121 and the primary VAD/SAD decision, 123 and optionally the source position information 122. It produces a spatial VAD/SAD decision 125 based on received parameters. If the source position is received, it is compared to the relevant positions stored in the position memory, and if there is a match the position is deemed relevant. Further, the identified position is updated at the end of the direct source segment or continuously during the direct source segment.

Figure 13:
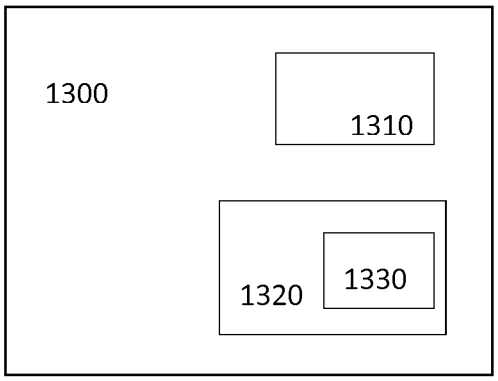
FIG. 13 shows an example of an apparatus performing the method.

FIG. 13 shows an example of an apparatus performing the method for voice or sound activity detection for spatial audio described above. The apparatus 1300 comprises a processor 1310, e.g. a central processing unit (CPU), and a computer program product 1320 in the form of a memory for storing the instructions, e.g. computer program 1330 that, when retrieved from the memory and executed by the processor 1310 causes the apparatus 1300 to perform processes connected with embodiments of the present spatial SAD/VAD. The processor 1310 is communicatively coupled to the memory 1320. The apparatus may further comprise an input node for receiving input channels, and an output node for outputting spatial VAD/SAD decision. The input node and the output node are both communicatively coupled to the processor 1310.

By way of example, the software or computer program 1330 may be realized as a computer program product, which is normally carried or stored on a computer-readable medium, preferably non-volatile computer-readable storage medium. The computer-readable medium may include one or more removable or non-removable memory devices including, but not limited to a Read-Only Memory (ROM), a Random Access Memory (RAM), a Compact Disc (CD), a Digital Versatile Disc (DVD), a Blue-ray disc, a Universal Serial Bus (USB) memory, a Hard Disk Drive (HDD) storage device, a flash memory, a magnetic tape, or any other conventional memory device.

The spatial VAD/SAD may be implemented as a part of a multi-channel speech/audio encoder. However, it does not need to be a part of an encoder but it may be communicatively coupled to the encoder.

Figure 2:
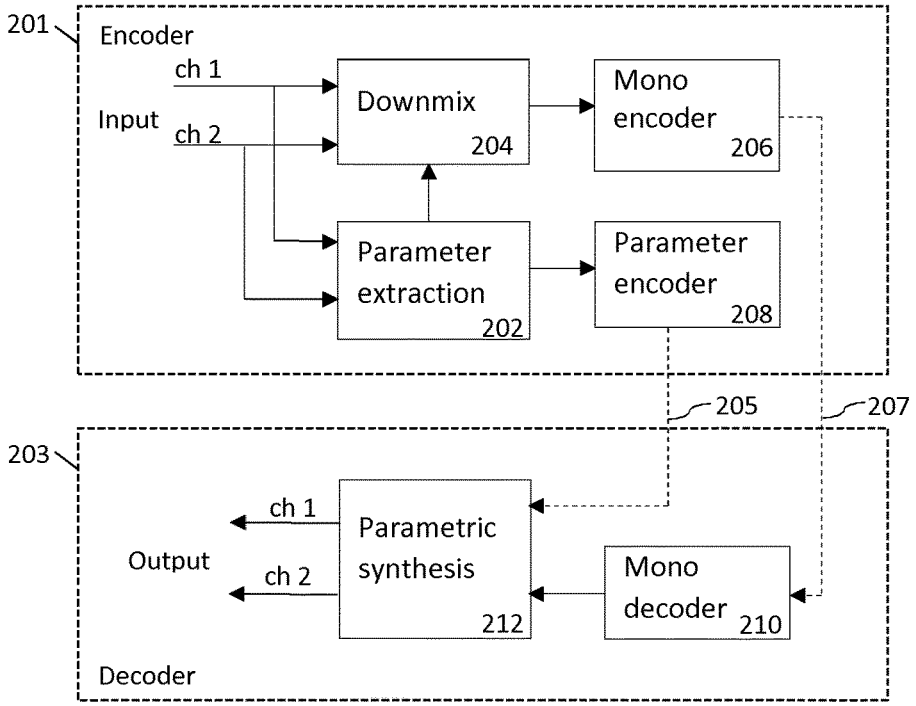
FIG. 2 is a block diagram of a parametric stereo encoder and decoder.
Figure 14:
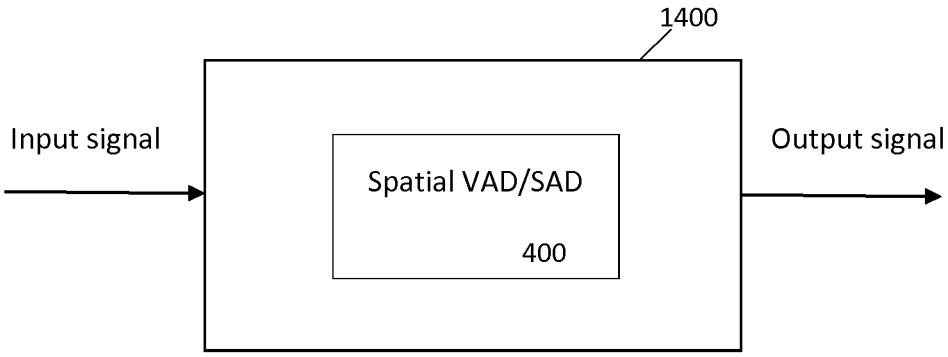
FIG. 14 shows a device comprising spatial VAD/SAD.

FIG. 14 shows a device 1400 comprising a spatial VAD/SAD 400 that is illustrated in FIGS. 4*a*-5*b*. The device may be an encoder, e.g., a speech or audio encoder. An input signal is a stereo or multi-channel audio signal. The output signal is an encoded mono signal with encoded parameters describing the spatial image. The device may further comprise a transmitter (not shown) for transmitting the output signal to an audio decoder. The device may further comprise a downmixer and a parameter extraction unit/module, and a mono encoder and a parameter encoder as shown in FIG. 2.

In an embodiment, a device comprises receiving unit for receiving multi-channel speech/audio input that comprises two or more input channels. The device further comprises producing units for producing spatial cues and a primary VAD/SAD decision based on analysis of the received input channels. The device further comprises detecting units for detecting presence of direct source and optionally detecting position of the source. The device further comprises producing unit for producing a spatial VAD/SAD decision based on the primary VAD/SAD decision and the direct source detection decision, and optionally on the source position information. Finally, the device comprises an output unit to for outputting spatial VAD/SAD decision.

According to example embodiments there is provided a method for voice or sound activity detection for spatial audio, the method comprising: receiving direct source detection decision (121) and a primary voice/sound activity decision (123); and producing a spatial voice/sound activity decision (125) based on said direct source detection decision and the primary voice/sound activity decision.

The spatial voice/sound activity decision may be set active if the direct source detection decision is active and the primary voice/sound activity decision is active. The spatial voice/sound activity decision may remain active as long as the direct source detection decision is active, even if the primary voice/sound activity decision goes inactive.

The method further comprising receiving source position information (122). The spatial voice/sound activity decision may be produced based on said direct source detection decision, said source position information and the primary voice/sound activity decision.

A relevant position decision may be determined by comparing a source position to relevant positions stored in a memory, and determining that the position is relevant if there is a match. The spatial voice/sound activity decision may be set active if the direct source detection decision is active and at least one of the primary voice/sound activity decision and the relevant position decision is active.

The method may further comprise receiving multi-channel input (111) that comprises two or more input channels; producing spatial cues (113) based on analysis of the received input channels; detecting presence of direct source (115) using said spatial cues; and producing (117) the primary voice/sound activity decision on the multi-channel input.

A position of direct source (114) may be detected using said spatial cues. The position of direct source may be represented by at least one of an inter-channel time difference (ICTD), an inter-channel level difference (ICLD), and an inter-channel phase differences (ICPD).

The primary voice/sound activity decision may be formed by performing a down-mix on channels of the multi-channel input and applying a monophonic voice/sound activity detection on the down-mixed signal. Alternatively, the primary voice/sound activity decision may be formed by performing a single-channel selection on channels of the multi-channel input and applying a monophonic voice/sound activity detection on the single-channel signal The detection of presence of direct source may be based on correlation between channels of the multi-channel input, such that high correlation indicates presence of direct source. A channel correlation may be represented by a measure of an inter-channel correlation (ICC). The presence of direct source may be detected if the ICC is above a threshold. The ICC is represented by maximum of the Generalized Cross Correlation with Phase Transform (GCC PHAT)

$$ICC(m) = \max_{\tau}(r_{xy}^{PHAT}[\tau, m]).$$

A background noise estimation may be performed in response to a spatial cue.

A spatial cue and the primary voice/sound activity decision may be used for acoustical scene analysis.

There is further provided an apparatus (400, 1300) for spatial voice or sound activity detection, the apparatus being configured to: receive direct source detection decision and a primary voice/sound activity decision; and produce a spatial voice/sound activity decision based on said direct source detection decision and the primary voice/sound activity decision.

The apparatus may be configured to set the spatial voice/sound activity decision active if the direct source detection decision is active and the primary voice/sound activity decision is active. The apparatus may be further configured to keep the spatial voice/sound activity decision active as long as the direct source detection decision is active, even if the primary voice/sound activity decision goes inactive The apparatus may further be configured to receive source position information. The apparatus may be configured to produce the spatial voice/sound activity decision based on said direct source detection decision, said source position information and the primary voice/sound activity decision.

The apparatus may be configured to determine a relevant position decision by comparing a source position to relevant positions stored in a memory, and determining that the position is relevant if there is a match. The apparatus may be configured to set the spatial voice/sound activity decision active if the direct source detection decision is active and at least one of the primary voice/sound activity decision and the relevant position decision is active.

The apparatus may further be configured to: receive multi-channel input that comprises two or more input channels; produce spatial cues based on analysis of the received input channels; detect presence of direct source using said spatial cues; and produce the primary voice/sound activity decision on the multi-channel input.

The apparatus may be configured to detect position of direct source using said spatial cues.

The apparatus may be configured to form the primary voice/sound activity decision by performing a down-mix on channels of the multi-channel input and applying a monophonic voice/sound activity detector on the down-mixed signal. Alternatively, the apparatus may be configured to form the primary voice/sound activity decision by performing a single-channel selection on channels of the multi-channel input and applying a monophonic voice/sound activity detector on the single-channel signal.

The apparatus may be configured to perform a background noise estimation in response to a spatial cue.

The apparatus may be configured to use a spatial cue and the primary voice/sound activity decision for acoustical scene analysis.

There is further provided an apparatus (400) comprising: an input for receiving a multi-channel input that comprises two or more input channels; a spatial analyser (401) configured to produce spatial cues based on analysis of the received input channels; a direct sound detector (403) configured to use said spatial cues for detecting presence of direct source; a primary sound activity detector (406) configured to produce a primary sound activity decision on the multi-channel input; and a secondary sound activity detector (408) configured to produce a spatial sound activity decision based on said direct source detection decision and the primary sound activity decision. The apparatus may further comprise a sound localizer (501) configured to use said spatial cues for detecting position of direct source. The secondary sound activity detector (408) may be configured to produce a spatial sound activity decision based on the direct source detection decision, source position information and the primary sound activity decision There is further provided a method for voice or sound activity detection, the method comprising: receiving (111) a spatial audio signal with more than a single audio channel; deriving (113) at least one spatial cue from said spatial audio signal; deriving (117) at least one monophonic feature based on a monophonic signal being derived from or a component of said spatial audio signal; and producing (119) a voice/sound activity decision based on said at least one spatial cue and said at least one monophonic feature.

The at least one spatial cue is at least one of: an inter-channel level difference (ICLD), an inter-channel time difference (ICTD), and an inter-channel coherence or correlation (ICC).

The at least one monophonic feature may be formed by performing a down-mix on received audio channels and applying a monophonic feature detection on the down-mixed signal. The at least one monophonic feature may be a primary voice/sound activity decision. Alternatively, the at least one monophonic feature may be formed by performing a single-channel selection on received audio channels and applying a monophonic feature detection on the single channel signal. The at least one monophonic feature may be a primary voice/sound activity decision Embodiments of the present invention may be implemented in software, hardware, application logic or a combination of software, hardware and application logic. The software, application logic and/or hardware may reside on a memory, a microprocessor or a central processing unit. If desired, part of the software, application logic and/or hardware may reside on a host device or on a memory, a microprocessor or a central processing unit of the host. In an example embodiment, the application logic, software or an instruction set is maintained on any one of various conventional computer-readable media.

It is to be understood that the choice of interacting units or modules, as well as the naming of the units are only for exemplary purpose, and may be configured in a plurality of alternative ways in order to be able to execute the disclosed process actions.

It should also be noted that the units or modules described in this disclosure are to be regarded as logical entities and not with necessity as separate physical entities. It will be appreciated that the scope of the technology disclosed herein fully encompasses other embodiments which may become obvious to those skilled in the art, and that the scope of this disclosure is accordingly not to be limited.

In the preceding description, for purposes of explanation and not limitation, specific details are set forth such as particular architectures, interfaces, techniques, etc. in order to provide a thorough understanding of the disclosed technology. However, it will be apparent to those skilled in the art that the disclosed technology may be practiced in other embodiments and/or combinations of embodiments that depart from these specific details. That is, those skilled in the art will be able to devise various arrangements which, although not explicitly described or shown herein, embody the principles of the disclosed technology. In some instances, detailed descriptions of well-known devices, circuits, and methods are omitted so as not to obscure the description of the disclosed technology with unnecessary detail. All statements herein reciting principles, aspects, and embodiments of the disclosed technology, as well as specific examples thereof, are intended to encompass both structural and functional equivalents thereof. Additionally, it is intended that such equivalents include both currently known equivalents as well as equivalents developed in the future, e.g. any elements developed that perform the same function, regardless of structure.

Thus, for example, it will be appreciated by those skilled in the art that the figures herein can represent conceptual views of illustrative circuitry or other functional units embodying the principles of the technology, and/or various processes which may be substantially represented in computer readable medium and executed by a computer or processor, even though such computer or processor may not be explicitly shown in the figures.

The functions of the various elements including functional blocks may be provided through the use of hardware such as circuit hardware and/or hardware capable of executing software in the form of coded instructions stored on computer readable medium. Thus, such functions and illustrated functional blocks are to be understood as being either hardware-implemented and/or computer-implemented, and thus machine-implemented.

The embodiments described above are to be understood as a few illustrative examples of the present invention. It will be understood by those skilled in the art that various modifications, combinations and changes may be made to the embodiments without departing from the scope of the present invention. In particular, different part solutions in the different embodiments can be combined in other configurations, where technically possible.

The invention claimed is:

1. A method for voice or sound activity detection for spatial audio, the method comprising:

receiving input signals;

analyzing the received input signals to produce a spatial cue;

using the spatial cue to determine whether a direct source is present;

generating a direct source detection decision indicating whether or not a direct source is determined to be present;

based on the received input signals, obtaining a primary activity decision, wherein the primary activity decision is a primary voice activity decision or a primary sound activity decision; and producing a spatial activity decision based on said direct source detection decision and the primary activity decision, wherein the spatial activity decision is a spatial voice activity decision or a spatial sound activity decision, wherein using the spatial cue to determine whether the direct source is present comprises:

comparing the spatial cue to a threshold value; and determining that the direct source is present as a result of determining that the spatial cue is greater than the threshold value, wherein the primary activity decision is formed by:

i) down-mixing channels of a multi-channel input into a down-mixed signal or ii) performing a single-channel selection on channels of a multi-channel input, thereby obtaining a single-channel signal, and applying a monophonic activity detection on the down-mixed signal or the single channel signal, and the monophonic activity detection is a monophonic voice activity detection or a monophonic sound activity detection.

2. The method of claim 1, wherein the spatial activity decision is set active if the direct source detection decision is active and the primary activity decision is active.

3. The method of claim 2, wherein the spatial activity decision remains active as long as the direct source detection decision is active, even if the primary activity decision switches from being active to being inactive.

4. The method of claim 1, further comprising obtaining source position information based on the spatial cue, wherein the spatial activity decision is produced from a voice activity detector by providing said direct source detection decision, said source position information, and the primary activity decision to the voice activity detector.

5. The method of claim 4, wherein the source position information indicates a source position, and the method further comprises:

comparing the source position to relevant positions indicated by position information stored in a memory;

determining if the source position matches any one of the relevant positions; and determining a relevant position decision based on the determination.

6. The method of claim 5, wherein the spatial activity decision is set active if the direct source detection decision is active and any one of the primary activity decision and the relevant position decision is active.

7. The method of claim 1, further comprising detecting a position of the direct source using said spatial cue.

8. The method of claim 7, wherein the position of the direct source is represented by at least one of an inter-channel time difference (ICTD), an inter-channel level difference (ICLD), and an inter-channel phase differences (ICPD).

9. The method of claim 1, wherein the detection of presence of the direct source is based on correlation between channels of a multi-channel input such that high correlation indicates presence of the direct source.

10. The method of claim 1, wherein the spatial cue comprises a degree of an inter-channel cross-correlation (ICC) indicating a diffuseness of a source.

11. The method of claim 1, wherein the threshold value is determined based on a standard deviation estimate of a cross correlation function.

12. The method of claim 1, wherein the spatial cue includes one or more measures that is determined by using a function of generalized cross correlation with phase transform (GCC PHAT).

13. The method of claim 1, wherein the primary activity is obtained by performing a monophonic activity detection.

14. An apparatus for spatial voice or sound activity detection, the apparatus being configured to:

receive input signals;

analyze the received input signals to produce a spatial cue;

use the spatial cue to determine whether a direct source is present;

generate a direct source detection decision indicating whether or not a direct source is determined to be present;

based on the received input signals, obtain a primary activity decision, wherein the primary activity decision is a primary voice activity decision or a primary sound activity decision; and produce a spatial activity decision based on said direct source detection decision and the primary activity decision, wherein the spatial activity decision is a spatial voice activity decision or a spatial sound activity decision, wherein using the spatial cue to determine whether the direct source is present comprises:

comparing the spatial cue to a threshold value; and determining that the direct source is present as a result of determining that the spatial cue is greater than the threshold value, wherein the primary activity decision is formed by:

i) down-mixing channels of a multi-channel input into a down-mixed signal or ii) performing a single-channel selection on channels of a multi-channel input, thereby obtaining a single-channel signal, and applying a monophonic activity detection on the down-mixed signal or the single channel signal, and the monophonic activity detection is a monophonic voice activity detection or a monophonic sound activity detection.

15. The apparatus of claim 14, further configured to set the spatial activity decision active if the direct source detection decision is active and the primary activity decision is active.

16. The apparatus of claim 15, further configured to keep the spatial activity decision active as long as the direct source detection decision is active, even if the primary activity decision switches from being active to being inactive.

17. The apparatus of claim 14, further configured to obtain source position information based on the spatial cue and produce the spatial activity decision from a voice activity detector by providing said direct source detection decision, said source position information, and the primary activity decision to the voice activity detector.

18. The apparatus of claim 17, wherein the source position information indicates a source position, and the apparatus is further configured to:

compare the source position to relevant positions indicated by position information stored in a memory, determine if the source position matches any one of the relevant positions, and determine a relevant position decision based on the determination.

19. The apparatus of claim 18, further configured to set the spatial activity decision active if the direct source detection decision is active and any one of the primary activity decision and the relevant position decision is active.

20. The apparatus of claim 14, further configured to detect a position of the direct source using said spatial cue.

21. The apparatus of claim 20, wherein the position of the direct source is represented by at least one of an inter-channel time difference (ICTD), an inter-channel level difference (ICLD), and an inter-channel phase differences (ICPD).

22. The apparatus of claim 14, wherein the detection of presence of the direct source is based on correlation between channels of a multi-channel input such that high correlation indicates presence of the direct source.

23. A multi-channel speech encoder or a multi-channel audio encoder comprising the apparatus according to claim 14.

24. A method for voice or sound activity detection for spatial audio, the method comprising:

receiving input signals;

analyzing the received input signals to determine a spatial cue;

using the spatial cue to determine whether a non-diffuse source is present;

generating a direct source detection decision indicating whether or not a non-diffuse source is determined to be present;

based on the received input signals, obtaining a primary activity decision, wherein the primary activity decision is a primary voice activity decision or a primary sound activity decision; and producing a spatial activity decision based on said direct source detection decision and the primary activity decision, wherein the spatial activity decision is a spatial voice activity decision or a spatial sound activity decision, wherein the primary activity decision is formed by:

i) down-mixing channels of a multi-channel input into a down-mixed signal or ii) performing a single-channel selection on channels of a multi-channel input, thereby obtaining a single-channel signal, and applying a monophonic activity detection on the down-mixed signal or the single channel signal, and the monophonic activity detection is a monophonic voice activity detection or a monophonic sound activity detection.

* * * * *